United States Patent [19]
Potier

[11] 3,934,637
[45] Jan. 27, 1976

[54] CASTING OF MOLTEN METALS

[75] Inventor: Pierre Roger Potier, La Celle-Saint-Cloud, France

[73] Assignee: Foseco International Limited, Birmingham, England

[22] Filed: Mar. 14, 1974

[21] Appl. No.: 451,369

[30] Foreign Application Priority Data

Mar. 28, 1973 United Kingdom ..... 14954/73

[52] U.S. Cl. ..... 164/56; 164/123; 164/138
[51] Int. Cl.[2] ..... B22D 27/18
[58] Field of Search ..... 164/123, 55, 133, 56, 72, 164/74, 138; 106/38.27, 38.9

[56] References Cited

UNITED STATES PATENTS

| | | | |
|---|---|---|---|
| 2,265,740 | 12/1941 | Morgan | 164/56 |
| 3,246,374 | 4/1966 | Belcher | 164/72 |
| 3,308,514 | 3/1969 | Osborn et al. | 164/123 |
| 3,323,869 | 6/1967 | Olstowski | 423/448 |
| 3,431,970 | 3/1969 | Olstowski et al. | 164/97 |
| 3,612,155 | 12/1971 | Matsuyama et al. | 164/123 |
| 3,685,986 | 8/1972 | Rutes et al. | 164/56 X |
| 3,810,506 | 5/1974 | Kobayashi | 164/133 |

*Primary Examiner*—Ronald J. Shore
*Attorney, Agent, or Firm*—Cushman, Darby & Cushman

[57] ABSTRACT

The surface quality of bottom poured ingots can be improved by placing on the mould floor, prior to pouring, a bonded composition of one or more fluxing agents and expandable graphite.

7 Claims, No Drawings

CASTING OF MOLTEN METALS

The present invention relates to the casting of molten metals to form ingots. While the method to be described may be used to advantage in the casting of various metals, its principal use is in the casting of steel ingots, and the following description is accordingly primarily directed to that use.

Ingot moulds may be charged with molten metal either by teeming the metal into the top of the ingot mould or by filling the ingot mould with molten metal from the base. The present invention is directed to this latter case, so-called bottom-pouring.

When molten steel is bottom-poured into an ingot mould there is a tendency for the surface of the molten metal to oxidise in contact with air and to form an oxide skin thereon. In addition, during solidification, the ingot tends to weld itself to the mould walls, and subsequent stripping from the mould, if not rendered impossible, may result in damage to the mould walls and/or defects in the ingot surface.

Heretofore, these disadvantages have been minimised by the use of mould additives or dressings, compositions which are applied to the interior of the mould or placed in the mould prior to casting and which, under the action of the heat of the molten metal, melt or decompose during the casting process with a resultant fluxing or reducing action at the molten metal/mould wall and/or molten metal/atmosphere interfaces. The compositions used for the purpose, however, have often had a tendency to alter the composition of the metal being cast, especially that at and near the surface of the cast ingot.

For example, it has been proposed to suspend a sack of particulate mould additive material in an ingot mould, heat from the molten metal causing the sack to disintegrate and allow the mould additive to fall on to the rising surface of the molten metal. This practice often causes the particles of the mould additive to become entrapped in the ingot causing metallurgical defects on solidification and subsequent rolling of the ingot. It has also been proposed to place the above sacks on the bottom of the mould prior to bottom-pouring. This practice has a further disadvantage in that the sacks are likely to burst thus causing the mould additive to block the runner.

It is an object of the present invention to improve the bottom-pouring of ingots by reducing the occurrence of ingot defects such as cold shuts and laps, reducing surface oxidation, and improving the general surface finish of the ingot surface. It is a further object of the invention to provide improved thermal insulation at the top of the ingot as the molten metal rises in the mould.

According to the present invention there is provided a process of ingot casting including bottom pouring molten metal into an ingot mould to form an ingot wherein there is located in the ingot mould prior to the commencement of pouring, a bonded composition comprising one or more fluxing agents and expandable graphite.

During casting, the bonded composition is borne up on the rising metal surface; because of the heat of the molten metal, the composition disintegrates under the expansion of the graphite and thereafter fuses to form a fluxing cover on the surface of the molten metal. This leads to an improvement of the surface finish of the cast ingot, less surface oxidation and a decrease in the level of surface inclusions. Furthermore, the presence of the composition on the rising metal surface protects that surface, which is turbulent because of the up-flowing molten metal, from contact with the atmosphere.

The expanded composition also forms a layer of high heat-insulating characteristics on the molten metal surface, thus reducing heat loss from the head metal during pouring.

Expandable graphite means particulate graphite the particles of which on heating, intumesce to give a low density highly heat insulative vermicular structure. These graphites may be prepared, for example, by treating flake graphite with nitric acid or mixtures of sulphuric acid with nitric acid, chromium trioxide or perchloric acid and the excess acid then removed by washing with water or neutralised by mixing a basic material such as bauxite or magnesium oxide with the treated flake graphite. The acid mixture may contain an inorganic oxidising agent such as manganese dioxide, potassium chlorate or potassium permanganate. The so treated graphite will, on heating, usually to temperatures in excess of 150°C, expand to many times its original volume. Methods of making such expandable graphite are disclosed in U.S. Pat. Nos. 1,137,373 and 3,323,869.

The bonded composition may have the following ingredients in the proportions indicated:-

| | |
|---|---|
| expandable graphite | 0.5% – 10% by weight |
| fluxing agent | 60% – 90% by weight |
| binder | 5% – 30% by weight |

The bonded composition may be produced using any binder or composition of binders suitable for the purpose. Such binders include organic binders such as natural or synthetic resins, gums, starches and cellulose derivatives. Preferred resins in this respect are urea-formaldehyde and phenol formaldehyde resins. Inorganic binders such as alkali metal silicates, colloidal oxide sols and clays may also be used. Preferred such inorganic binders include sodium silicate (waterglass), colloidal silica sol and bentonite or ball clay. A combination of organic and inorganic binders may be used.

The fluxing agent may be any known for use in the flux treatment of molten metals. Suitable fluxing agents include iron oxide ($Fe_2O_3$ or $Fe_3O_4$), sodium carbonate (soda ash), potassium carbonate, alkali metal and alkaline earth metal fluorides, alkali metal oxides or substances which yield alkali metal oxides on heating, natural or synthetic silicates such as basalt and wollastonite, natural or synthetic borates such as calcium borate or colemanite, and fly ash. Mixtures of such fluxing agents may be used to provide compositions adapted to the casting temperature of the molten metal.

Where the metal being cast is steel the fluxing agents of choice are fly ash, soda ash or fluorspar, ground blastfurnace slag, ground cupola slag or suitable melting point mixtures of the two slags. Advantageously the fluxing agent is in particulate form with the particles at least in part coated with very finely divided carbon. Such coated fluxing agents may be produced by mixing the particulate fluxing agent together with a proportion of finely divided carbon until the requisite coated or partially coated particles are obtained. The carbon used for coating the fluxing agent may be the expandable graphite itself or additionally another form of finely divided carbon may be used, e.g. finely crushed coke, graphite, charcoal or burnt cork flour, lamp black, carbon black and acetylene black; these last three are preferred since they are initially finer particle size.

The bonded composition may also contain e.g. a minor proportion up to 10% by weight, of inorganic or organic fibres. This is in order to increase the mechanical strength of the product.

Examples of suitable fibres are asbestos, slag wool, glass wool, rock wool, aluminosilicate fibre and paper pulp. The inclusion of fibre is preferred if the composition is to be made by a slurry method as described below.

Particulate refractory fillers such as silica, alumina, magnesia, chamotte, vermiculite and perlite may also be included The bonded composition may be made by blending the dry ingredients, for example in a cone blender, adding to the dry ingredients a solution of the binder, usually in water, forming the composition into the desired shape by ramming or pressing in a suitable mould, and curing the shaped composition after removal from the mould.

The bonded composition may also be prepared by forming a slurry of the ingredients in a carrier liquid such as water, locating the slurry in a vessel having a mesh wall, removing liquid from the slurry through the mesh wall so as to deposit a mat of the solid constituents of the slurry on the mesh wall, separating the mat so formed from the mesh wall, and drying the mat. The removal of the carrier liquid may be achieved by the application of pressure or vacuum as desired. The presence of fibre in the bonded composition is particularly desirable when the composition is prepared from a slurry.

The following example will serve to illustrate the invention:

EXAMPLE

A bonded composition having the following composition by weight:

| | |
|---|---|
| fly ash | 65.0% |
| calcium borate | 5.0% |
| graphite | 6.0% |
| expandable graphite | 4.0% |
| phenol-formaldehyde resin | 20.0% |

was prepared using the following procedure.

The fly ash, calcium borate, graphite and expandable graphite were thoroughly mixed in the dry state in a cone blender. A 60% by weight aqueous solution of the phenolformaldehyde resin was then added to the dry ingredients. the "green" composition was then pressed in a mould to form a pad 25 mm thick, and the pad was cured, after removal from the mould, for 2 hours at 150°C.

The pad was then placed at the bottom of a 1½ tonne ingot mould and molten steel at 1650°C was bottom-poured into the mould. After the steel had solidified the ingot was stripped from the mould and examined. The ingot showed little evidence of inclusions and surface oxidation and the surface finish was good.

We claim:

1. In the process of ingot casting wherein molten metal is bottom poured into an ingot mould to form an ingot, the improvement which comprises locating in the ingot mould, prior to the commencement of pouring, a bonded composition comprising at least one fluxing agent and expandable graphite, said composition being borne up on the rising molten metal surface as the molten metal is poured and disintegrating because of the heat of said metal and the expansion of the graphite and thereafter fusing to form a fluxing cover on the surface of the molten metal thereby minimizing surface oxidation and surface inclusions.

2. The process of claim 1 wherein the fluxing agent is selected from the class consisting of iron oxide, alkali metal and alkaline earth metal fluorides, carbonates and oxides, silicates, borates and fly ash.

3. The process according to claim 1 wherein the fluxing agent is in particulate form and the particles thereof are coated with finely divided carbon.

4. The process of claim 1 wherein the composition comprises, by weight:

| | |
|---|---|
| fluxing agent | 60 – 90% |
| expandable graphite | 0.5 – 10% |
| binder | 10 – 30% |

5. The process of claim 1 wherein the composition is bonded with a binding agent selected from the class consisting of natural and synthetic resins, gums, starches, cellulose derivatives, alkali metal silicates, colloidal oxide hydrosols and clays.

6. The process of claim 1 wherein the composition includes fibrous material.

7. The process of claim 1 wherein the composition includes a particulate refractory filler.

* * * * *